US008136304B2

(12) United States Patent
Sternbach

(10) Patent No.: US 8,136,304 B2
(45) Date of Patent: Mar. 20, 2012

(54) DOWNSPOUT CLAW

(76) Inventor: Jozsef Sternbach, Scarsdale, NY (US)

( * ) Notice: Subject to any disclaimer, the term of this patent is extended or adjusted under 35 U.S.C. 154(b) by 0 days.

(21) Appl. No.: 12/716,423

(22) Filed: Mar. 3, 2010

(65) Prior Publication Data

US 2011/0214360 A1 Sep. 8, 2011

(51) Int. Cl.
*E04D 13/00* (2006.01)
*E04D 13/08* (2006.01)

(52) U.S. Cl. ..... 52/12; 52/11; 52/16

(58) Field of Classification Search ..... 52/11–16
See application file for complete search history.

(56) References Cited

U.S. PATENT DOCUMENTS 543,922 A * 8/1895 Buckley ..... 210/249
608,765 A * 8/1898 Epple ..... 137/873
1,653,473 A * 12/1927 Schulz ..... 210/130
4,523,875 A * 6/1985 DiFiore ..... 405/50
4,798,028 A * 1/1989 Pinion ..... 52/16
5,119,849 A * 6/1992 Hinkley ..... 134/104.1
5,526,612 A * 6/1996 Wade ..... 52/12
5,709,051 A * 1/1998 Mazziotti ..... 52/12
5,985,158 A * 11/1999 Tiderington ..... 210/767
6,024,127 A * 2/2000 Johnson ..... 137/873
6,076,307 A * 6/2000 Kean ..... 52/11
6,219,972 B1 * 4/2001 Zusy ..... 52/12
6,240,679 B1 * 6/2001 Smalara ..... 52/16
6,263,618 B1 * 7/2001 Jones ..... 52/12
6,497,816 B2 * 12/2002 Naddy ..... 210/162
6,668,492 B2 * 12/2003 Warns ..... 52/12
7,007,429 B2 * 3/2006 Kim ..... 52/16
7,334,369 B2 * 2/2008 Carson ..... 52/11
7,584,577 B2 * 9/2009 Esmond et al. ..... 52/12
7,805,890 B2 * 10/2010 Esmond et al. ..... 52/12
7,895,793 B1 * 3/2011 Yates ..... 52/12
7,919,002 B1 * 4/2011 Hurtado ..... 210/747.2
8,006,720 B1 * 8/2011 Kotansky ..... 137/873
8,033,058 B2 * 10/2011 Block ..... 52/12
2002/0073630 A1 * 6/2002 Warns ..... 52/12
2003/0051414 A1 * 3/2003 Bessette ..... 52/16
2003/0167700 A1 * 9/2003 Esmond et al. ..... 52/12
2005/0109693 A1 * 5/2005 Allard ..... 210/446
2006/0150531 A1 * 7/2006 Cann ..... 52/11
2007/0125005 A1 * 6/2007 Carson ..... 52/11
2008/0086953 A1 * 4/2008 Graf ..... 52/12
2008/0229673 A1 * 9/2008 LaMorte et al. ..... 52/12

* cited by examiner

*Primary Examiner* — Mark Wendell

(57) ABSTRACT

The Downspout Claw is made of clear plastic which enables one to see any debris which may have collected on its fingered protrusions inside the downspout pipe. The Claw may be used as a secondary or additional device to collect debris in the downspout pipe. The invention may be removed, cleaned and replaced without the need of any tools.

1 Claim, 2 Drawing Sheets

DOWNSPOUT CLAW

The Downspout Claw (Claw) is a clear plastic piece molded to allow for the attachment into an aperture on a downspout pipe.

BACKGROUND OF INVENTION

Typical buildings or houses have systems to control rainwater; composed of gutters (horizontal component) and leader pipes or downspout pipes (vertical component). Occasionally the gutters or downspouts may become clogged restricting the flow of water. This invention provides an additional collection and cleaning location to existing or future systems.

BRIEF SUMMARY OF THE INVENTION

The present invention provides for a visual inspection of any debris which may have collected by the Claw, on its fingered protrusions, in the downspout pipe. The Claw may be removed from the downspout pipe to be cleaned of any debris which may have collected on it.

BRIEF DESCRIPTION OF DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
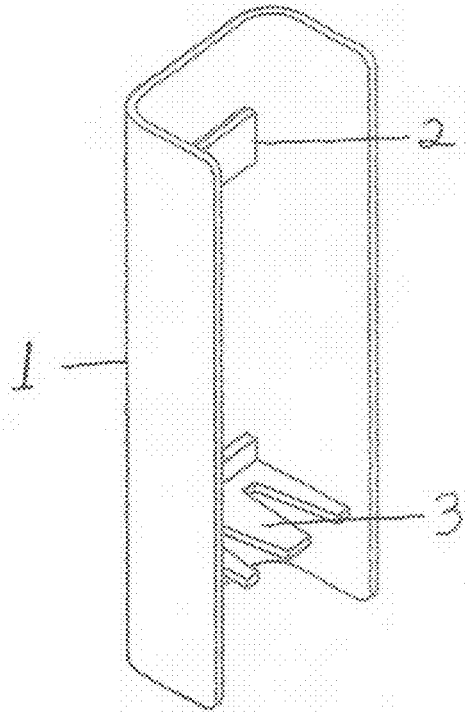
FIG. 1 is a perspective view of the Claw.

Referring to the drawings and initially to FIG. 1, the Downspout Claw (1) comprises a member U-shaped in cross section and with an approximate length of ten inches. Near one end is the upper hook (2). At the other end is the lower hook and fingered protrusions (3) used to collect the debris.

Figure 2:
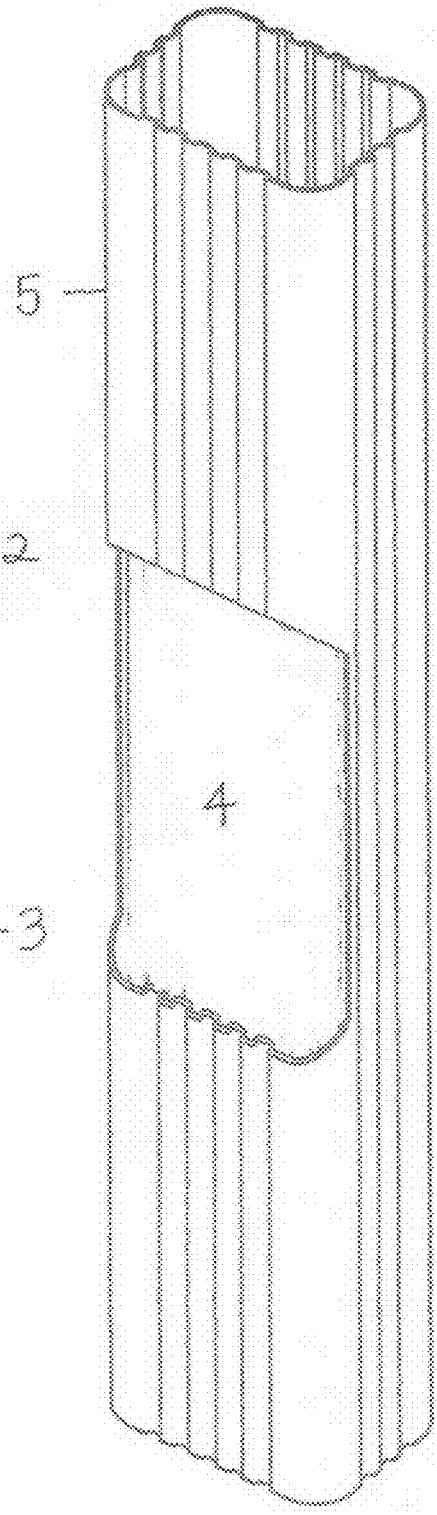
FIG. 2 is a perspective view of the existing downspout and aperture.

As best can be seen by reference to FIG. 2, an aperture (4) is cut into the existing downspout pipe (5). The recommended height is 4'-0" above finished grade, to facilitate the visual inspections, removal and reattachment. A template will be provided to aid in the cutting of the correct size aperture for the downspout pipe.

Figure 3:
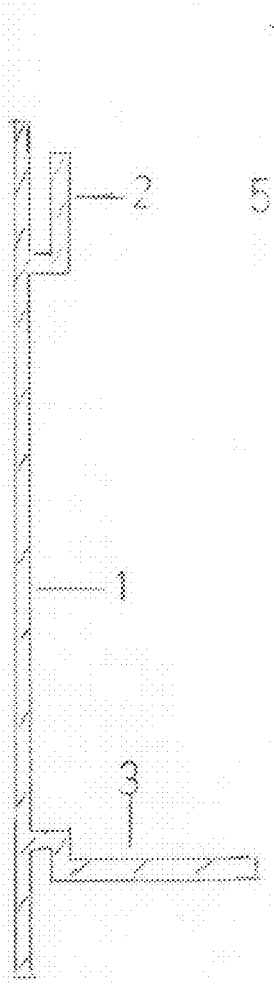
FIG. 3 is a section view of the Claw.

As best can be seen by reference to FIG. 3, this section view of the Claw (1) shows the upper hook (2) and the lower hook and fingered protrusion (3)

Figure 4:
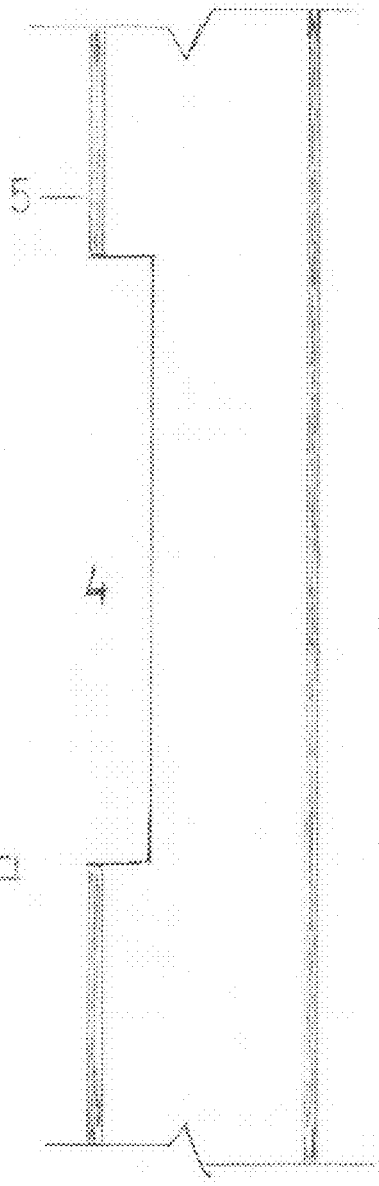
FIG. 4 is a section view of the existing downspout and aperture.

As best can be seen by reference to FIG. 4, these sections view of the existing downspout pipe (5) with the aperture (4).

Figure 5:
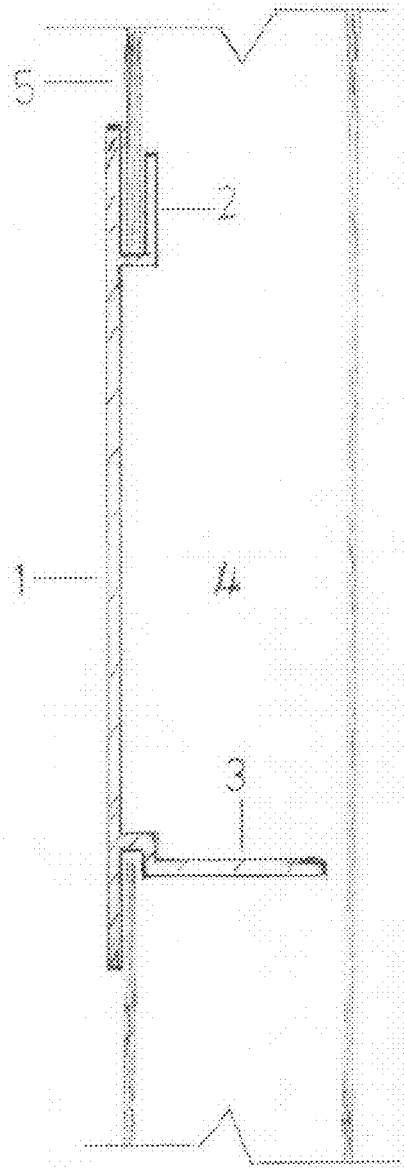
FIG. 5 is a section view of the Claw and the existing downspout and aperture.

As best can be seen by reference to FIG. 5, this section view shows the Claw (1) properly installed in the downspout pipe (5).

I claim:

1. A downspout claw, comprising:

An elongated, channeled element having a web and two side flanges creating an open channel;

said elongated, channeled element sealingly engaging and releasably mounting over a downspout aperture;

wherein said elongated, channeled element is made from a clear, plastic material for visually inspecting the contents of the downspout;

wherein said elongated, channeled element further includes, a plastic upper hook for engaging the downspout pipe along the inner surface, the upper hook being proximate one end of the open channel; and a lower hook for engaging the downspout and a fingered protrusion for the capture of debris within the downspout pipe, the lower hook and fingered protrusion being proximate an opposite end of the open channel;

wherein upon removing said elongated, channeled element from said downspout, debris captured by said fingered protrusion can be removed from the claw.

* * * * *